US011684136B1

(12) United States Patent
Zheng et al.

(10) Patent No.: US 11,684,136 B1
(45) Date of Patent: Jun. 27, 2023

(54) COSMETIC PACKAGE AND AN APPLICATOR HEAD FOR APPLYING A FLUID PRODUCT

(71) Applicant: APR Beauty Group Inc., Toronto (CA)

(72) Inventors: Min-Yan Zheng, Richmond Hill (CA); Feng-Ying Fu, Toronto (CA); Jun Shen, Lighthouse Point, FL (US)

(73) Assignee: APR Beauty Group, Inc., Toronto (CA)

( * ) Notice: Subject to any disclaimer, the term of this patent is extended or adjusted under 35 U.S.C. 154(b) by 0 days.

(21) Appl. No.: 18/150,540

(22) Filed: Jan. 5, 2023

(51) Int. Cl.
*A45D 34/04* (2006.01)
*A45D 40/26* (2006.01)

(52) U.S. Cl.
CPC ..... *A45D 34/045* (2013.01); *A45D 34/041* (2013.01); *A45D 40/261* (2013.01); *A45D 40/265* (2013.01)

(58) Field of Classification Search
CPC .... A45D 34/04; A45D 34/041; A45D 34/043; A45D 34/045; A45D 34/046; A45D 40/26; A45D 40/261; A45D 40/264; A45D 40/265; A45D 40/267
USPC ..... 401/126–130, 208, 209, 216
See application file for complete search history.

(56) References Cited

U.S. PATENT DOCUMENTS 11,219,292 B2 * 1/2022 Bianco ..... A45D 34/041
2015/0257510 A1 * 9/2015 Kim ..... A45D 34/045 401/126

FOREIGN PATENT DOCUMENTS

WO WO2016123411 A1 8/2016

* cited by examiner

*Primary Examiner* — David J Walczak
(74) *Attorney, Agent, or Firm* — Jason L DeFrancesco

(57) ABSTRACT

An applicator head for applying a fluid product including a cosmetic, care, or pharmaceutical product onto the keratinous substrate. The applicator head includes an applying member elongated along a longitudinal axis. The applying member has tubular body with a closed proximal end and an open distal end. The applying member includes a sidewall and an interior longitudinal cavity having an opening at the open distal end of the applying member. The applying member, at its distal end portion, has a ball socket for rotatably mounting a spherical ball. The spherical ball can discharge the fluid product by rotation. The sidewall includes at least two through feed openings that allow filling of the internal longitudinal cavity with the fluid product when the applying member is dipped in the receptacle. A portion of the spherical ball protrudes from the ball socket beyond the open distal end of the applying member.

20 Claims, 4 Drawing Sheets

COSMETIC PACKAGE AND AN APPLICATOR HEAD FOR APPLYING A FLUID PRODUCT

BACKGROUND

Field

The present disclosure generally relates to a cosmetic package and an applicator head for applying a product including a cosmetic, care, or pharmaceutical product, onto a keratinous substrate such as skin, lips, under eyes, eyelids, cheeks, nails, or any other part of the body. Particularly, it relates to an applicator head that includes a spherical ball for massaging and cooling functions.

Description of the Related Art

Cosmetic applicators such as dip or wand applicators are known in the cosmetic industry. Cosmetic packages often include applicators for dispensing a particular cosmetic contained in the package reservoir. The cosmetic applicator generally includes a stem with a cap at one end and an applicator head in the form of a brush, spatula, or other applicator structure suitable for applying a cosmetic or a care product including viscous cosmetics, lip gloss, lip color, wound care, under-eye cosmetics, pharmaceutical and like products.

A PCT patent application, WO2016123411A1, discloses an applicator wand having a roller ball applicator at its distal end, wherein the distal end of the elongate applicator wand which is flocked at least in part. The roller ball is held within a hollow cap which fits over the distal end of wand.

The conventional applicators, the cosmetic applicator has to be dipped into cosmetic bulk several times in a repeated manner to complete the entire application process. Thus, the cosmetic applicator capable of holding a considerable amount of cosmetic liquid is required. Further, a cosmetic package with an applicator head that provides massaging and cooling function along with the cosmetic application is desirable.

SUMMARY

It is an object of the present disclosure to provide a cosmetic package that can be easily configured to contain a fluid product and an applicator head.

It is an object of the present disclosure to provide an applicator head that can apply a cosmetic product, care, or pharmaceuticals, or like products onto a keratinous surface such as lips, skin, under-eye, and cheeks, particularly lips. Further, the fluid product can be a liquid, viscous or semi-solid product.

It is a further object to provide an applicator head that can apply a larger amount of cosmetic product without the need to re-dipping the applicator into the cosmetics supply occasionally, wherein the applicator head is configured in a simple and functionally reliable manner.

It is yet another object of the present disclosure to provide an applicator head that is very simple to use, economical to manufacture.

Accordingly, there is provided an applicator head according to an exemplary embodiment of the present disclosure. The applicator head comprises an applying member at its distal portion and a shank member at its proximal portion. The applying member of the applicator head is configured to apply the fluid product including a cosmetic or care product.

The applying member has tubular body with a closed proximal end and an open distal end. The applying member includes a sidewall extending along a longitudinal axis of the applicator head. An interior longitudinal cavity extends from near the closed proximal end portion of the applying member and opens at the open distal end of the applying member. An outer surface of the sidewall of the applying member is majorly cylindrical and a majority of an inner surface of the sidewall is cylindrical too. The sidewall of the applying member tapers inwardly terminating at a circular rim surrounding and forming an opening at the open distal end. In other words, the sidewall has a chamfered end formed at the open distal end of the applying member, the chamfered end comprising a chamfer formed at a peripheral side surface thereof. The applying member is provided in its open distal end portion with a ball socket in which a spherical ball is rotatable mounted. The spherical ball is configured to be contacted on a user's skin and discharge the fluid product by rotation. The sidewall includes at least two through feed openings that diametrically opposing and are connected to the internal longitudinal cavity of the applying member. The interior longitudinal cavity is in fluid communication with the receptacle through the two through feed openings, and delivers to the surface of spherical ball.

According to a preferred embodiment, an outer surface of the applying member is smooth and devoid of flocked fibers. The applying member is an unflocked application-ready plastic surface.

According to a preferred embodiment, the sidewall of the applying member has a constant outer diameter about at least 80% of its length.

According to a preferred embodiment, the chamfer of the sidewall at the open distal end of the applying member has an angle less than 45 degrees. Preferably, the angle of the chamfer is in the range of 10° to 20°.

According to an aspect of the present disclosure, the diameter of the chamfered end of the sidewall is less than rest of the diameters of the sidewall.

The applicator head according to the first embodiment is configured to be part of a cosmetic package. The cosmetic package comprises a receptacle for holding a fluid product and a cosmetic applicator. The cosmetic applicator comprises the applicator head, a stem, and a cap. The cap of the cosmetic applicator may have threads that can be screwed onto threads formed on the neck of the receptacle. The applicator head is retained at a distal end of the stem for applying the fluid product; and the cap at a proximal end of the stem. Further, the distal end of the stem includes an interior longitudinal cavity for receiving and retaining the applicator head. More particularly, the shank member is configured to be received and retained within the longitudinal cavity of the stem. There may be provided a wiper in the neck of the receptacle for wiping off excess fluid product from the cosmetic applicator.

In general, the use of the terms "distal" and "proximal" herein is supposed to mean that the distal is the end facing towards the bottom of the storage receptacle, whereas the proximal is the end facing towards the removal opening of the receptacle.

In the first embodiment, the shank member and the applying member are integral, however in alternate embodiments that may be two separate parts. The applying member is designed to apply the product to a target surface.

According to an aspect of the present disclosure, the applicator head of the cosmetic applicator may be used to apply the fluid product contained in the receptacle including a cosmetic or care product. The cosmetic or care product includes lip gloss, skincare, under-eye cosmetics, pharmaceutical, and like products. The fluid product may be a liquid or semi-liquid product.

According to another aspect of the present disclosure, the applicator head and the applying member are elongated along a central longitudinal axis of the cosmetic applicator.

According to another aspect of the present disclosure, near the open distal end portion of the applying member, an inner surface of the sidewall of the applying member forms the ball socket for rotatably housing the spherical ball. Thus, the spherical ball is held freely rotatably by applying member near the open distal end. Further, the ball socket is formed by reducing the thickness of the sidewall. The inner surface of the sidewall is concavely curved at a distal end portion of the sidewall defining the ball socket. The inner surface of the ball socket is concavely curved to a contour similar to the spherical ball. Thus, the inner surface of the ball socket conforms to the shape of the spherical ball so that the rear of the spherical ball contacts with the ball socket. This ball socket is connected to the interior longitudinal cavity at its center.

According to yet another aspect of the present disclosure, when spherical ball is seated on the ball socket, a portion of the spherical ball protrudes from the ball socket beyond the circular rim. In other words, the spherical ball is partly exposed outside from the opening at the open distal end of the applying member. The spherical ball is of larger diameter than the circular rim such that only a portion of the spherical ball extends beyond the opening.

According to another aspect of the present disclosure, the opening is defined through an inner peripheral edge of the circular rim and has a smaller diameter than the diameter of the spherical ball, retaining the spherical ball within the ball socket. According to yet another preferred embodiment, the circular rim has diameter 5.43 mm and the ball socket has a maximum diameter of 6.2 mm. The diameter of the spherical ball is 6 mm. In alternate embodiments, the diameter of the spherical ball may be smaller or larger than 6 mm, and accordingly the circular rim and ball socket may have dimensions that are suitable for rotatably holding the spherical ball.

According to an aspect of the present disclosure, the circular rim and the opening at the open distal end of the applying member extend in a plane orthogonal to the longitudinal axis of the applying member.

In a preferred embodiment, the spherical ball protrudes from about 0.5 to 2 millimeter beyond the circular rim, more preferably about 1.5 millimeter, for a ball diameter of about 6 millimeter.

When the applying member is dipped into the receptacle, some amount of the fluid product will flow into the internal longitudinal cavity through the at least two through feed openings. After that applying member is removed from the receptacle, the fluid product is then applied by rolling the spherical ball against an application surface. The spherical ball rotates and transports the fluid product from the internal longitudinal cavity.

According to an aspect of the present disclosure, the circular rim and the sidewall of the applying member can be brought into contact with the part of the skin to be treated for the application of the cosmetic. The circular rim and the sidewall of the applying member are embodied as unflocked application-ready plastic surfaces.

According to an aspect of the present disclosure, a length of the applying member is selected from a range of between 10-20 mm, preferably, 15-18 mm. A width of the applying member is selected from a range of between 6-8.5 mm, preferably, 7.5 mm.

According to an aspect of the present disclosure, the internal longitudinal cavity carries a sufficient volume of the fluid product therein for adequate product application. Thus, a user does not need to re-dip the applying member into the receptacle frequently during the application. According to a preferred embodiment, the length of the internal longitudinal cavity is selected from a range of between 14-17 mm. A width of the internal longitudinal cavity is selected from a range of between 3.5-7 mm. In a preferred embodiment, the internal longitudinal cavity is spaced at least 1 mm and at most 2 mm away from the proximal end of the applying member.

According to yet another aspect of the present disclosure, the dimensions of each of the two through feed openings, is large enough to allow easy and quick filling of the internal longitudinal cavity when the applying member is dipped in the receptacle. A length of each of the at least two through feed openings, is at least one-third of the length of the applying member, and a width of the each of the at least two through feed openings, is at least half of the width of the applying member. The length of each of the two through feed openings, measured along the longitudinal axis of the applicator head, is selected from a range of between 4-6 mm, more particularly, 4.5-5.5 mm. The width of the each of the two through feed openings, measured orthogonally to the longitudinal axis of the applicator head, is selected from a range of 3-5 mm. In a preferred embodiment, the width is 3-3.5 mm.

According to yet another aspect of the present disclosure, the at least two through feed openings, are located on the sidewall of the applying member equidistance from both proximal end and the distal end of the applying member.

Thus, when the applying member is removed from the receptacle containing the fluid product, the applying member is wiped through the wiper. The fluid product is applied on the skin by moving the spherical ball along the skin. The spherical ball of the applying member may serve to locally spread the cosmetic, if necessary, or to outline a contour.

According to an embodiment of the present disclosure, at least a part and preferably all of the applicator head can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

According to an embodiment of the present disclosure, the spherical ball at least in part is made of a thermal material such as stainless steel, ceramic, stone, or an alloy. In a preferred embodiment, the spherical ball is made of stainless steel. The spherical ball provides properties including rolling, massaging and cooling effects.

In the first embodiment, the wiper serves to wipe off not only the excess fluid product attached to the applying member but also the fluid product attached to the stem.

According to the first embodiment, the receptacle and the cap may be made of a rigid material like glass, metal, hard plastic, or any other material known in the art. However, in alternate embodiments, the receptacle and the cap may be made of a flexible material like flexible polymeric material or any other material known in the art.

According to the first embodiment of the present disclosure, the stem presents a circular cross-section, but it is not beyond the ambit of the present disclosure for this to be otherwise, in particular when the cross-section of the stem is oval, elliptical, or polygonal, e.g. square, triangular or rectangular. The stem can be solid as shown, or, in a variant, it could be hollow.

When the stem is not of circular cross-section, the cap can be fastened on the receptacle by snap-fastening or by some other means, without turning relative to said receptacle. The wiper can thus present a non-circular wiper orifice of the section that is complementary to the section of the stem.

According to an embodiment of the present disclosure, the applicator head can be made, at least in part, from a material that is more flexible than the material from which the stem is made.

According to the first embodiment of the present disclosure, the applicator head and the stem are fitted together by a snap fitment. However, in alternate embodiments, the applicator head and the stem may be fit together by friction fit, gluing, crimping, magnetic engagement, and the like.

According to the first embodiment of the present disclosure, the stem can have a longitudinal axis that is rectilinear as shown. However, in alternate embodiments, it could be curved.

The present invention introduces such refinements. In its preferred embodiments, the present invention has several aspects or facets that can be used independently, although they are preferably employed together to optimize their benefits. All of the foregoing operational principles and advantages of the present invention will be more fully appreciated upon consideration of the following detailed description, with reference to the drawings.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
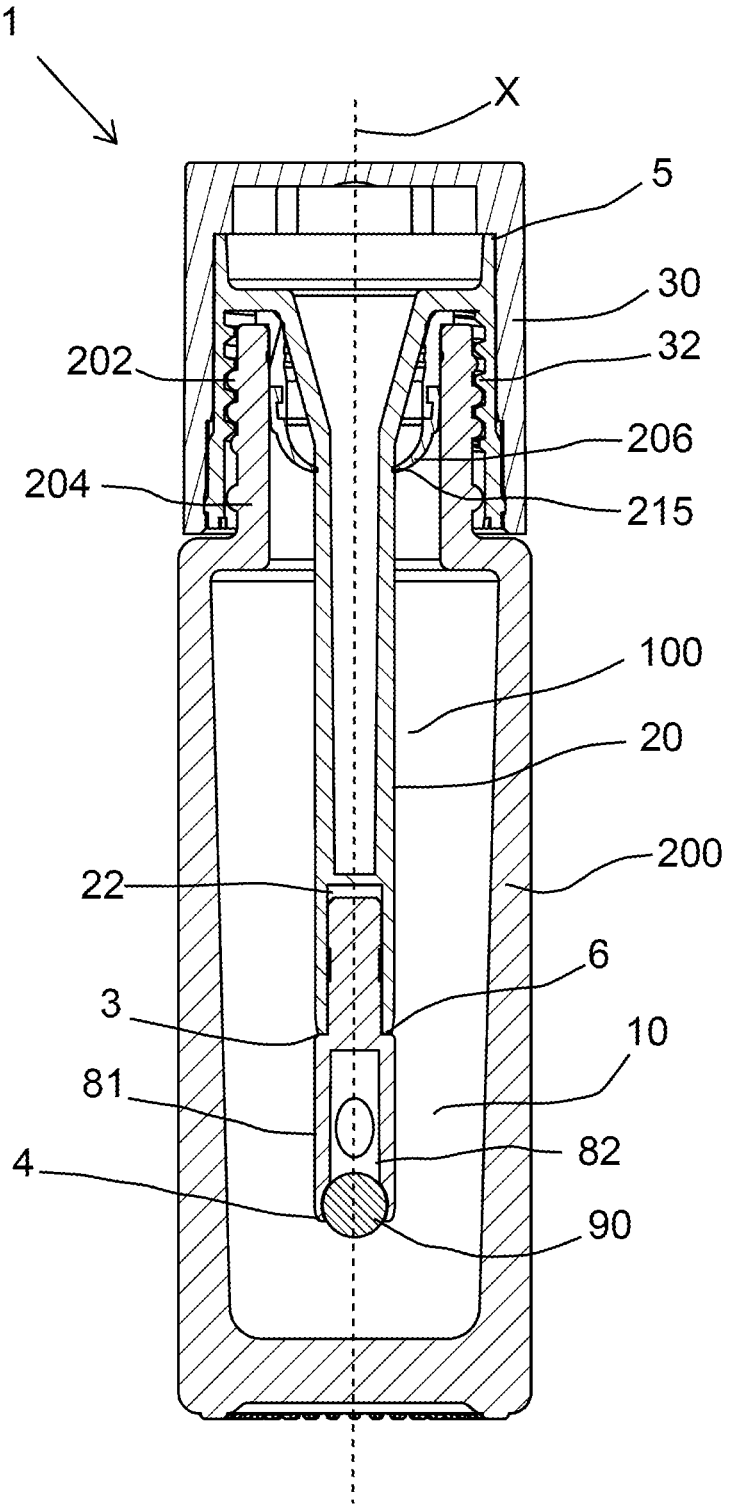
FIG. 1 illustrates a longitudinal cross-sectional view of a cosmetic package equipped with a cosmetic applicator according to a first embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered limited by the foregoing description.

Throughout this specification, the terms "comprise," "comprises," "comprising" and the like, shall consistently mean that a collection of objects is not limited to those objects specifically recited.

Figure 2:
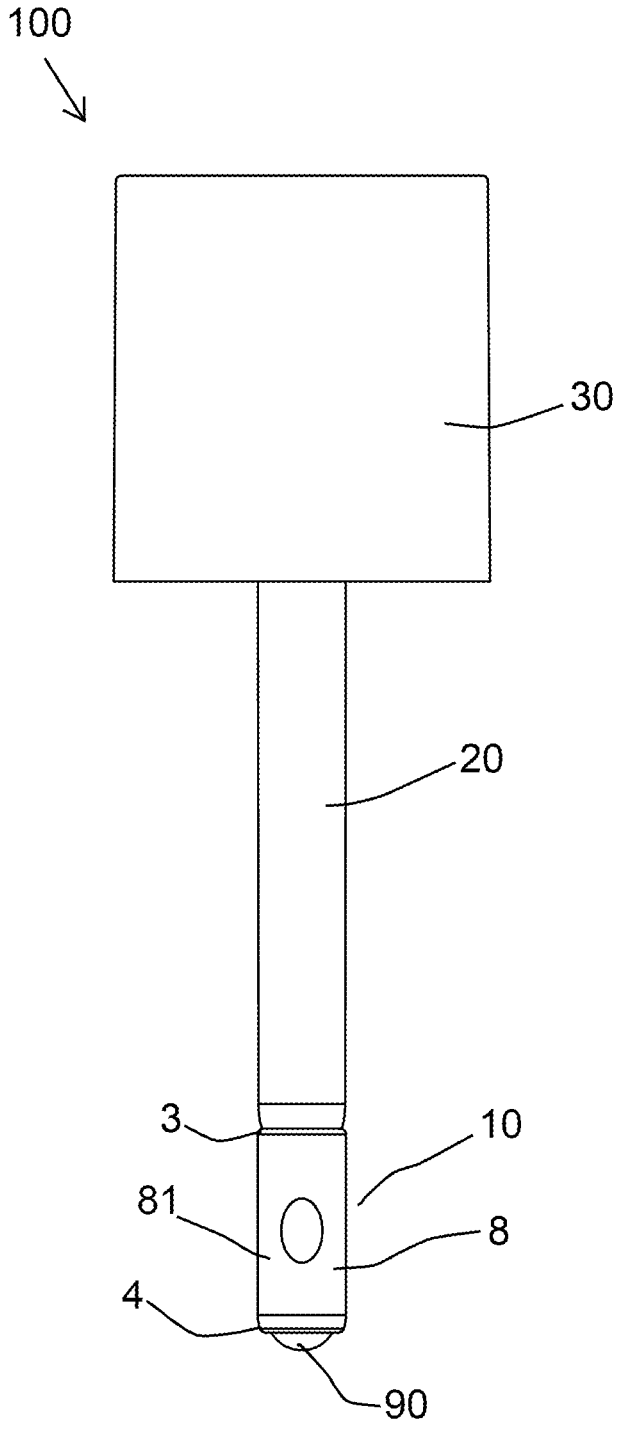
FIG. 2 illustrates a front view of the cosmetic applicator of FIG. 1.

FIG. 1 illustrates a longitudinal sectional view of a cosmetic package 1. The cosmetic package 1 comprises a receptacle 200 for holding a fluid product (not shown) and a cosmetic applicator 100. The cosmetic applicator 100 comprises an applicator head 10, a stem 20, and a cap 30, see FIG. 2. The cap 30 of the cosmetic applicator 100 has threads 32 that can be screwed onto threads 202, formed on a neck 204 of the receptacle 200. The applicator head 10 is retained at a distal end 6 of the stem 20 for applying the fluid product; and the cap 30 at a proximal end 5 of the stem 20.

In general, the use of the terms "distal" and "proximal" herein is supposed to mean that the distal is the end facing towards the inside of the receptacle 200, whereas the proximal is the end facing towards the removal opening of the receptacle 200.

As seen in FIG. 1, the distal end 6 of the stem 20 includes an interior longitudinal cavity 22 for receiving and retaining the applicator head 10. Inserted in the neck 204 of the receptacle 200 is a wiper 206 for wiping off excess fluid product from the cosmetic applicator 100.

Further, the applicator head 10 of the cosmetic applicator 100 may be used to apply the fluid product contained in the receptacle including a cosmetic or care product. The cosmetic or care product includes lip gloss, hair color, skincare, under-eye cosmetics, pharmaceutical, and like products. The fluid product may be a liquid or semi-liquid product.

Figure 3:
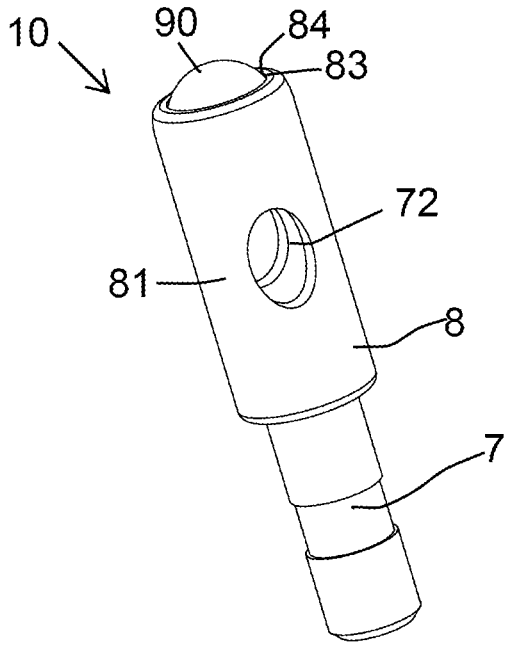
FIG. 3 illustrates a perspective view of an applicator head of the cosmetic applicator of FIG. 2.
Figure 4:
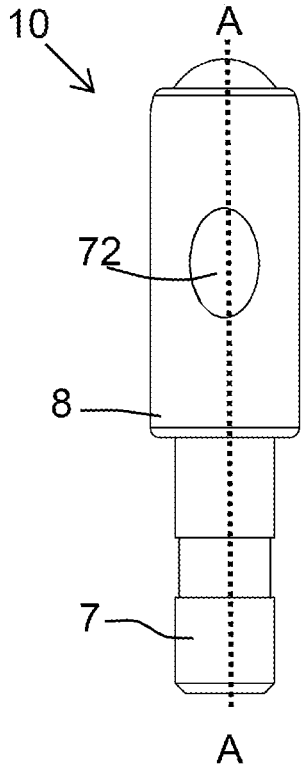
FIG. 4 illustrates a front view of the applicator head of FIG. 2.
Figure 5:
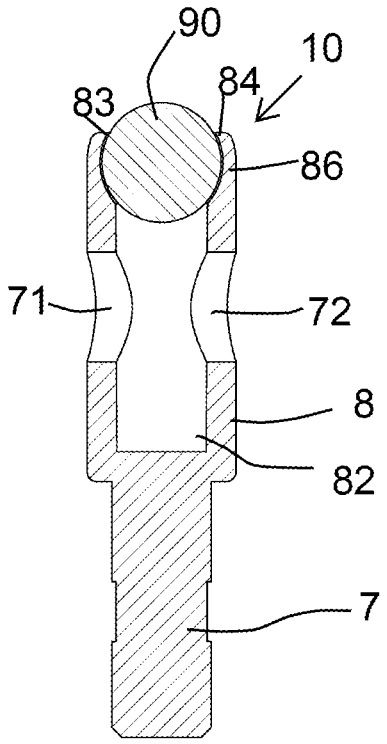
FIG. 5 illustrates a longitudinal cross-sectional view, taken along a line A-A, of the applicator head of FIG. 4.
Figure 6:
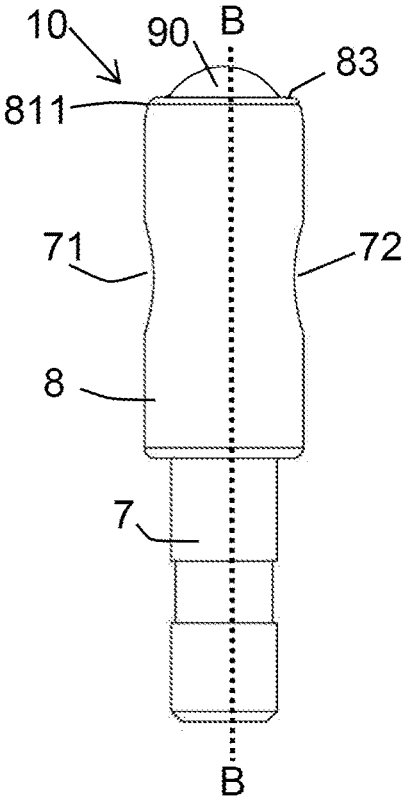
FIG. 6 illustrates a side view of the applicator head of FIG. 2.

As shown in FIGS. 3-5, the applicator head 10 comprises an applying member 8 at its distal portion and a shank member 7 at its proximal portion. The shank member 7 is configured to be received and retained within the interior longitudinal cavity 22 of the stem 20 (see FIG. 1).

In the present embodiment, the shank member 7 and the applying member 8 are integral, however, in alternate embodiments that may be two separate parts.

The applicator head 10 and the applying member 8 are elongated along a central longitudinal axis X of the cosmetic applicator 100 (refer to FIG. 1). The applying member 8 has tubular body with a closed proximal end 3 and an open distal end 3. The distal end 4 and the proximal end 4 of the applying member 8 are opposite relative to the axis X and are separated, along said axis X.

Referring to FIGS. 3-9, the applying member 8 has a sidewall 81 extending along the longitudinal axis X of the cosmetic applicator 100. The applying member 8 has an interior longitudinal cavity 82 that extends from near the closed proximal end 3 of the applying member 8 and opens at the open distal end 4 of the applying member 8, refer FIG. 9.

According to a preferred embodiment, as seen in FIGS. 3-9, an outer surface of the applying member 8 is smooth and devoid of flocked fibers. The applying member 8 is an unflocked application-ready plastic surface.

Figure 9:
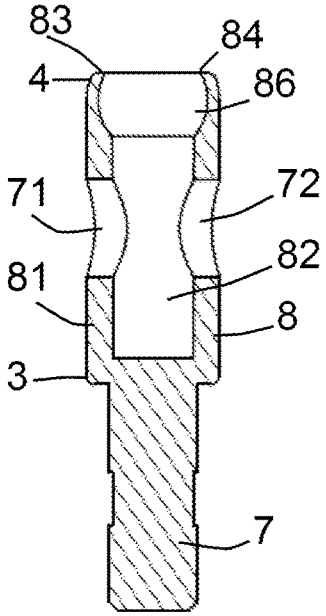
FIG. 9 illustrates a longitudinal cross-sectional view of an applying member of the applicator head of FIG. 8

Referring FIG. 9, the outer surface of the sidewall 81 is majorly cylindrical and a majority of an inner surface of the sidewall 81 is cylindrical too. The sidewall 81 of the applying member 8 tapers inwardly terminating at a circular rim 83 surrounding and forming an opening 84 at the open distal end 4, see FIGS. 8 and 9. In other words, the sidewall 81 has a chamfered end 811 formed at the open distal end 4 of the applying member 8, the chamfered end 811 comprising a chamfer formed at a peripheral side surface of the sidewall 81, refer FIGS. 6 and 7.

According to a preferred embodiment, the chamfered end 811 of the sidewall 81 has an angle less than 45 degrees. Preferably, the angle of the chamfered end 811 is in the range of 10° to 20°.

According to an aspect of the present disclosure, a diameter of the chamfered end 811 of the sidewall 81 is less than rest of diameters of the sidewall 81.

Referring to FIGS. 5, 7-9, the applying member 8 is provided in its distal end portion with a ball socket 86 in which a spherical ball 90 is rotatably mounted. More particularly, near the distal end portion of the applying member 8, an inner surface of the sidewall 81 forms a ball socket 86 for rotatably housing the spherical ball 90. The spherical ball 90 is configured to be contacted on a user's skin and discharge the fluid product by rotation. Thus, the spherical ball 90 is held freely rotatably by applying member 8 near the distal end 4.

The opening 84 is defined through an inner peripheral edge of the circular rim 83 wherein the opening 84 and/or the circular rim 83 has a smaller diameter than a diameter of the spherical ball 90, retaining the spherical ball 90 within the ball socket 86, see FIG. 5.

Figure 7:
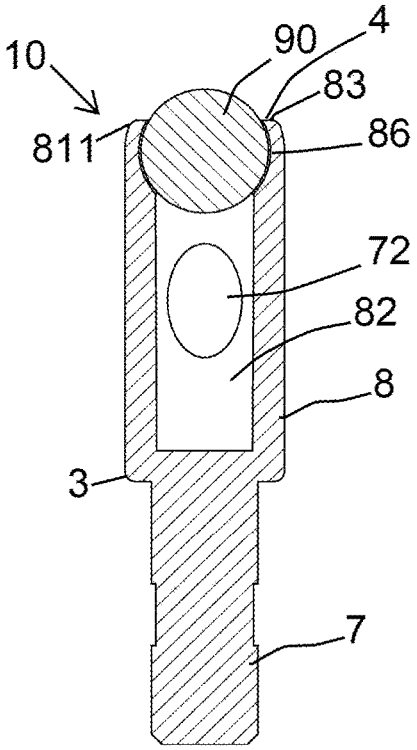
FIG. 7 illustrates another longitudinal cross-sectional view, taken along a line B-B of the applicator head of FIG. 6.
Figure 8:
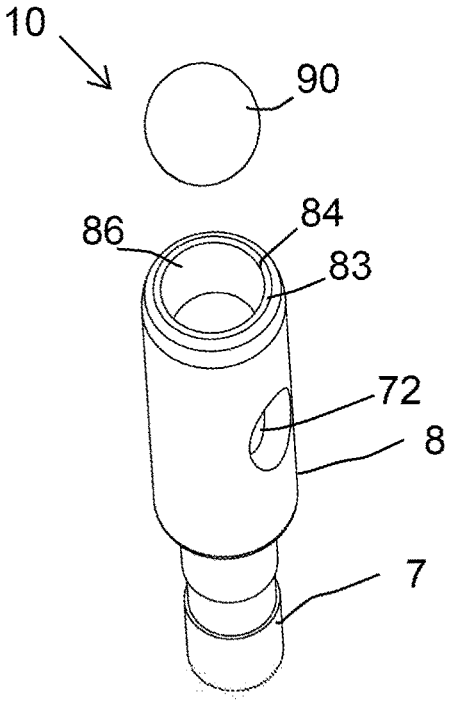
FIG. 8 illustrates an exploded view of the applicator head of FIG. 2.

Further, as seen in FIGS. 5, 7, and 9, the ball socket 86 is formed by reducing the thickness of the sidewall 81. The inner surface of the sidewall 81 is concavely curved at an distal end portion of the sidewall 81 defining the ball socket 86. The inner surface of the ball socket 86 is concavely curved to a contour similar to the spherical ball 90. Thus, the inner surface of the ball socket 86 conforms to the shape of the spherical ball 90 so that the rear of the spherical ball 90 contacts with the ball socket 86. This ball socket 86 is connected to the interior longitudinal cavity 82 at its center, refer FIG. 9.

FIGS. 3-7, when spherical ball 90 is seated on the ball socket 86, a portion of the spherical ball 90 protrudes from the ball socket 86 beyond the circular rim 83. In other words, the spherical ball 90 is partly exposed outside from the opening 84 of the ball socket 86 at the open distal end 4 of the applying member 8. The spherical ball 90 is of larger diameter than the circular rim 83 such that only a portion of the spherical ball 90 extends beyond the opening 84. According to yet another aspect of the present disclosure, the circular rim 83 has diameter 5.43 mm and the ball socket 86 has a maximum diameter of 6.2 mm. The diameter of the spherical ball 90 is 6 mm.

According to an aspect of the present disclosure, the circular rim 83 and the opening 84 at the open distal end 4 of the applying member 8 extend in a plane orthogonal to the longitudinal axis X of the applying member 8.

In a preferred embodiment, the spherical ball 90 protrudes from about 0.5 to 2 millimeter beyond the circular rim 83, more preferably about 1.5 millimeter, for a ball diameter of about 6 millimeter.

Further, as seen in FIGS. 3, 4, 5, and 7-9, the sidewall 81 includes at least two through opposing openings 71, 72 that are connected to the internal longitudinal cavity 82. The interior longitudinal cavity 82 is in fluid communication with the receptacle 200 through the two through openings 71, 72, and delivers to the surface of spherical ball 90.

The sidewall 81 has a constant outer diameter over at least 80% of its length. The outer diameter of the sidewall, according to preferred embodiment is in range of 6-8 mm.

When the applying member 8 is dipped into the receptacle 200, some amount of the fluid product will flow into the internal longitudinal cavity 82 through the feed openings 71 and 72. After that applying member 8 is removed from the receptacle 200, the fluid product is then applied by rolling the spherical ball 90 against an application surface. The spherical ball 90 rotates and transports the fluid product from the internal longitudinal cavity 82.

According to an aspect of the present disclosure, the circular rim 83 and the sidewall 81 of the applying member 8 can be brought into contact with the part of the skin to be treated for the application of the cosmetic. The circular rim 83 and the sidewall 81 of the applying member 8 are embodied as unflocked application-ready plastic surfaces.

According to an aspect of the present disclosure, a length of the applying member 8 is selected from a range of between 10-20 mm, preferably, 15-18 mm. A width of the applying member 8 is selected from a range of between 6-8.5 mm, preferably, 7.5 mm.

According to an aspect of the present disclosure, the internal longitudinal cavity 82 carries a sufficient volume of the fluid product therein for adequate product application. Thus, a user does not need to re-dip the applying member 8 into the receptacle 200 frequently during the application. According to a preferred embodiment, a length of the internal longitudinal cavity 82 is selected from a range of between 14-17 mm. A width of the internal longitudinal cavity 82 is selected from a range of between 3.5-7 mm. In a preferred embodiment, the internal longitudinal cavity 82 is spaced at least 1 mm and at most 3 mm away from the proximal end 3 of the applying member 8.

According to yet another aspect of the present disclosure, the dimensions of each of the at least two through feed openings 72, 73 is large enough to allow easy and quick filling of the internal longitudinal cavity 82 when the applying member 8 is dipped in the receptacle 200. A length of each of the at least two through feed openings 72, 73 is at least one-third of the length of the applying member 8, and a width of the each of the at least two through feed openings 72, 73 is at least half of the width of the applying member 8. The length of each of the at least two through feed openings 72, 73, measured along the longitudinal axis X, is selected from a range of between 4-6 mm, more particularly, 4.5-5.5 mm. The width of the each of the through feed openings 72, 73, measured orthogonally to the longitudinal axis X, is selected from a range of 3-5 mm. In a preferred embodiment, the width is 3-3.5 mm.

Further, as seen in FIGS. 3-7, the at least two through feed openings 72, 73 are located on the sidewall 81 of the applying member 8 equidistance from both closed proximal end 3 and the open distal end 4 of the applying member 8.

Thus, when the applying member 8 is removed from the receptacle 200 containing the fluid product, the applying member 8 is wiped through the wiper 206. The fluid product is applied on the skin by moving the spherical ball 90 along the skin. The spherical ball 90 of the applying member 8 may serve to locally spread the cosmetic, if necessary, or to outline a contour.

According to an embodiment of the present disclosure, at least a part and preferably all of the applicator head 10 can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

According to an embodiment of the present disclosure, the spherical ball 90 at least in part is made of a thermal material such as stainless steel, ceramic, stone, or an alloy. The spherical ball thus is able to provide properties including rolling, massaging and cooling effects.

In the first embodiment, the wiper 206 serves to wipe off not only the excess fluid product attached to the applying member 8 but also the fluid product attached to the stem 20.

According to the first embodiment, the receptacle 200 and the cap 30 may be made of a rigid material like glass, metal, hard plastic, or any other material known in the art. However, in alternate embodiments, the receptacle 200 and the cap 30 may be made of a flexible material like flexible polymeric material or any other material known in the art.

According to the first embodiment of the present disclosure, the stem 20 presents a circular cross-section, but it is not beyond the ambit of the present disclosure for this to be otherwise, in particular when the cross-section of the stem 20 is oval, elliptical, or polygonal, e.g. square, triangular or rectangular. The stem 20 can be solid as shown, or, in a variant, it could be hollow.

When the stem 20 is not of circular cross-section, the cap 30 can be fastened on the receptacle 200 by snap-fastening or by some other means, without turning relative to said receptacle 200. The wiper 206 can thus present a non-circular wiper orifice 215 of the section that is complementary to the section of the stem 20.

According to an embodiment of the present disclosure, the applicator head 10 can be made, at least in part, from a material that is more flexible than the material from which the stem 20 is made.

According to the first embodiment of the present disclosure, the applicator head 10 and the stem 20 are fitted together by a snap fitment. However, in alternate embodiments, the applicator head 10 and the stem 20 may be fit together by friction fit, gluing, crimping, magnetic engagement, and the like.

According to the first embodiment of the present disclosure, the stem 20 can have a longitudinal axis that is rectilinear as shown. However, in alternate embodiments, it could be curved.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the invention. In addition, those skilled in the art may readily change or modifications to the disclosed embodiments, based on the present specification, such changes or modifications also belong to the scope of the present disclosure will be apparent.

What is claimed is:

1. A cosmetic package for storing a fluid product, the cosmetic package comprising:

a receptacle for holding the fluid product;

a cosmetic applicator comprises an applicator head for applying the fluid product;

wherein the applicator head includes an applying member;

wherein the applying member including a sidewall extending along a longitudinal axis of the applicator head;

wherein the applying member includes an interior longitudinal cavity extending from a proximal end portion to an open distal end of the applying member;

wherein an outer surface of the sidewall of the applying member is cylindrical and a majority of an inner surface of the sidewall is cylindrical;

wherein the sidewall has a constant outer diameter over at least 80% of its length;

wherein the sidewall has chamfered end near a distal end portion of the applying member; and wherein the chamfered end terminates at a circular rim surrounding an opening of the interior longitudinal cavity at the open distal end;

wherein the inner surface of the sidewall of the applying member forms a ball socket, for rotatably housing a spherical ball, near the distal end portion of the applying member;

wherein the sidewall includes at least two through feed openings that are diametrically opposing;

wherein when the applying member is dipped into the receptacle, the at least two through feed openings allows some amount of the fluid product to flow into the internal longitudinal cavity and delivers fluid product to an outer surface of the spherical ball;

wherein an outer surface of the applying member is smooth and devoid of flocked fibers;

wherein the ball socket is formed by reducing the thickness of the sidewall and wherein the inner surface of the sidewall, defining the ball socket, is concavely curved to a contour similar to the spherical ball;

wherein the inner surface of the ball socket conforms to the shape of the spherical ball so that a rear of the spherical ball contacts with the ball socket; and wherein when spherical ball is seated on the ball socket, a portion of the spherical ball protrudes from the ball socket beyond the circular rim from the opening at the open distal end of the applying member.

2. The cosmetic package according to claim 1, wherein the spherical ball at least in part is made of a thermal material selected from a group of stainless steel, ceramic, stone, and an alloy.

3. The cosmetic package according to claim 1, wherein the spherical ball has a larger diameter than a diameter of the circular rim such that only a portion of the spherical ball extends beyond the opening.

4. The cosmetic package according to claim 1, wherein an angle of the chamfered end is in the range of 10° to 20°; and wherein a diameter of the chamfered end of the sidewall is less than a rest of diameters of the sidewall.

5. The cosmetic package according to claim 1, wherein the opening of the interior longitudinal cavity is defined through an inner peripheral edge of the circular rim; and wherein the opening and/or the circular rim has a smaller diameter than a diameter of the spherical ball for retaining the spherical ball within the ball socket.

6. The cosmetic package according to claim 5, wherein the circular rim has a diameter of 5.43 mm and the ball socket has a maximum diameter of 6.2 mm and wherein the diameter of the spherical ball is 6 mm.

7. The cosmetic package according to claim 1, wherein the spherical ball protrudes beyond the circular rim about 1.5 millimeter.

8. The cosmetic package according to claim 1, wherein a length of the internal longitudinal cavity is selected from a range of 14-17 mm; and wherein a width of the internal longitudinal cavity is selected from a range of 3.5-7 mm.

9. The cosmetic package according to claim 1, wherein the internal longitudinal cavity of the applying member is spaced at least 1 mm and at most 3 mm away from the proximal end of the applying member.

10. The cosmetic package according to claim 1, wherein a length of each of the at least two through feed openings, is at least one-third of a length of the applying member; and wherein a width of the each of the at least two through feed openings, is at least half of a width of the applying member.

11. The cosmetic package according to claim 10, wherein the length of each of the two through feed openings, measured along the longitudinal axis of the applicator head, is selected from a range of 4.5-5.5 mm; and wherein the width of the each of the two through feed openings, measured orthogonally to the longitudinal axis of the applicator head, is selected from a range of 3-3.5 mm.

12. The cosmetic package according to claim 1, wherein the two through feed openings are located on the sidewall of the applying member equidistance from both the closed proximal end and the open distal end of the applying member.

13. The cosmetic package according to claim 1, wherein a length of the applying member is selected from a range of 15-18 mm; and wherein a width of the applying member is selected from a range of 6-8.5 mm.

14. The cosmetic package according to claim 1, wherein the cosmetic applicator comprises the applicator head, a stem, and a cap; and wherein the applicator head is retained at a distal end of the stem for applying the fluid product and the cap at a proximal end of the stem.

15. A cosmetic package for storing a fluid product, the cosmetic package comprising:

a receptacle for holding the fluid product;

a cosmetic applicator comprises an applicator head for applying the fluid product;

wherein the applicator head includes an applying member;

wherein the applying member has tubular body with a closed proximal end and an open distal end;

wherein the applying member includes a sidewall extending along a longitudinal axis of the applicator head from the closed proximal end to open the distal end;

wherein an interior longitudinal cavity extending from a proximal end portion of the applying member to the open distal end of the applying member;

wherein the internal longitudinal cavity of the applying member is spaced at least 1 mm and at most 3 mm away from the closed proximal end of the applying member;

wherein the sidewall terminates at a circular rim surrounding an opening of the interior longitudinal cavity at the open distal end of the applying member;

wherein an inner surface of the sidewall of the applying member forms a ball socket, for rotatably housing a spherical ball, near a distal end portion of the applying member;

wherein the sidewall includes at least two through feed openings that are diametrically opposing;

wherein when the applying member is dipped into the receptacle, the at least two through feed openings allows some amount of the fluid product to flow into the internal longitudinal cavity and delivers fluid product to an outer surface of the spherical ball;

wherein an outer surface of the applying member is smooth and devoid of flocked fibers; and wherein when spherical ball is seated on the ball socket, a portion of the spherical ball protrudes from the ball socket beyond the circular rim from the opening at the open distal end of the applying member.

16. The cosmetic package according to claim 15, wherein the ball socket is formed by reducing the thickness of the sidewall and wherein the inner surface of the sidewall, defining the ball socket, is concavely curved to a contour similar to the spherical ball; and wherein the inner surface of the ball socket conforms to the shape of the spherical ball so that a rear of the spherical ball contacts with the ball socket.

17. The cosmetic package according to claim 15, wherein the spherical ball at least in part is made of a thermal material selected from a group of stainless steel, ceramic, stone, and an alloy.

18. The cosmetic package according to claim 15, wherein an outer surface of the sidewall of the applying member is majorly cylindrical and a majority of an inner surface of the sidewall is cylindrical; and wherein the sidewall has a constant outer diameter over at least 80% of its length.

19. A cosmetic package for storing a fluid product, the cosmetic package comprising:

a receptacle for holding the fluid product;

a cosmetic applicator comprises an applicator head for applying the fluid product;

wherein the applicator head includes an applying member;

wherein the applying member has tubular body with a closed proximal end and an open distal end;

wherein the applying member includes a sidewall extending along a longitudinal axis of the applicator head from the closed proximal end to open the distal end;

wherein an interior longitudinal cavity extending from a proximal end portion of the applying member to the open distal end of the applying member;

wherein the sidewall terminates at an opening of the interior longitudinal cavity at the open distal end;

wherein an inner surface of the sidewall of the applying member forms a ball socket, for rotatably housing a spherical ball, near a distal end portion of the applying member;

wherein the sidewall includes at least two through feed openings that are diametrically opposing;

wherein when the applying member is dipped into the receptacle, the two through feed openings allows some amount of the fluid product to flow into the internal longitudinal cavity and delivers fluid product to the surface of spherical ball;

wherein a length of each of the two through feed openings, is at least one-third of a length of the applying member; and wherein a width of the each of the two through feed openings, is at least half of a width of the applying member; and wherein when the spherical ball is seated on the ball socket, a portion of the spherical ball protrudes from the opening at the open distal end of the applying member.

20. The cosmetic package according to claim 19, wherein the sidewall terminates at a circular rim surrounding the opening of the interior longitudinal cavity at the open distal end; and wherein the circular rim extends in a plane orthogonal to the longitudinal axis of the applicator head.

* * * * *